US010518308B2

(12) United States Patent
Ernst De La Graete

(10) Patent No.: US 10,518,308 B2
(45) Date of Patent: Dec. 31, 2019

(54) ROLLING MILL SUCH AS, FOR EXAMPLE, A COLD ROLLING MILL

(71) Applicant: FIVES DMS, Noyelles-les-Seclin (FR)

(72) Inventor: Conrad Ernst De La Graete, Noyelles-les-Seclin (FR)

(73) Assignee: FIVES DMS, Noyelles-les-Seclin (FR)

( * ) Notice: Subject to any disclaimer, the term of this patent is extended or adjusted under 35 U.S.C. 154(b) by 410 days.

(21) Appl. No.: 15/322,915

(22) PCT Filed: Jun. 26, 2015

(86) PCT No.: PCT/FR2015/051738

§ 371 (c)(1),
(2) Date: Dec. 29, 2016

(87) PCT Pub. No.: WO2016/001541

PCT Pub. Date: Jan. 7, 2016

(65) Prior Publication Data

US 2017/0151594 A1 Jun. 1, 2017

(30) Foreign Application Priority Data

Jul. 1, 2014 (FR) ..... 14 56289

(51) Int. Cl.
*B21B 45/02* (2006.01)
*B21B 13/14* (2006.01)
(Continued)

(52) U.S. Cl.
CPC ..... *B21B 45/0233* (2013.01); *B21B 13/02* (2013.01); *B21B 13/147* (2013.01);
(Continued)

(58) Field of Classification Search
None
See application file for complete search history.

(56) References Cited

U.S. PATENT DOCUMENTS 2,776,586 A 1/1957 Sendzimir
3,998,084 A * 12/1976 Rerecich ..... B21B 37/74 72/201
2015/0336146 A1* 11/2015 Charre ..... B21B 27/10 72/43

FOREIGN PATENT DOCUMENTS

CN 202180090 U * 4/2012 ..... B21B 45/0218
EP 2 676 744 A1 12/2013
(Continued)

OTHER PUBLICATIONS

International Search Report, dated Oct. 19, 2015, from corresponding PCT application.

*Primary Examiner* — Shelley M Self
*Assistant Examiner* — Jared O Brown
(74) *Attorney, Agent, or Firm* — Young & Thompson

(57) ABSTRACT

A rolling mill includes a frame, at least one pair of working cylinders capable of defining the air gap of the strip to be rolled, as well at least one line for spraying a lubricant and/or coolant fluid, arranged next to the plane of the strip to be rolled. The line is rigidly connected to the frame via a hinged mechanical link, the mechanical link including a resilient unit forcing the line into at least one operational position, toward the plane of the strip, and allowing, in the event that a force on the line tends to separate the line, greater than a threshold value, the deformation of the resilient unit against the return force thereof, and thus the retraction of the line toward a position separated from the at least one operational position.

15 Claims, 5 Drawing Sheets

(51) Int. Cl.
*B21B 13/02* (2006.01)
*B21B 27/10* (2006.01)

(52) U.S. Cl.
CPC ..... *B21B 27/10* (2013.01); *B21B 45/0218* (2013.01); *B21B 45/0251* (2013.01); *B21B 2027/103* (2013.01)

(56) References Cited

FOREIGN PATENT DOCUMENTS

JP S5620126 A * 2/1981 ..... B21B 45/0218
JP H11 285712 A 10/1999

* cited by examiner

ROLLING MILL SUCH AS, FOR EXAMPLE, A COLD ROLLING MILL

BACKGROUND OF THE INVENTION

Field of the Invention

The invention relates to a rolling mill, such as for example a cold rolling mill, and more particularly a rolling mill known by those skilled in the art under the name "20 High".

Description of the Related Art

Such a rolling mill, taught by document U.S. Pat. No. 2,776,586, comprises a frame inside of which rolling cylinders are arranged.

The rolling cylinders comprise two working cylinders defining the air gap of the strip to be rolled, as well as a set of first intermediate cylinders and a set of second intermediate cylinders for the support of each working cylinder (lower and upper).

These rolling cylinders are supported by several sets of rollers bearing on the second intermediate cylinders, on either side of the plane of the strip to be rolled.

In a rolling mill of the "20 High" type, the first intermediate cylinders are of a number of two, and said second intermediate cylinders are of a number of three (for each working cylinder, upper or lower). Eight sets of rollers bear on the second intermediate cylinders, on either side of the plane of the strip to be rolled.

It is moreover known to lubricate/cool the strip and/or the working cylinders by the spraying of a cooling/lubricating fluid, in the upper portion and in the lower portion of the strip.

The spraying of this fluid is typically provided by spraying lines, marked 56a and 57 in FIG. 4 of document U.S. Pat. No. 2,776,586.

These lines extend over the width of the strip to be rolled, in the frame of the rolling mill, on an inter-space between the upper intermediate cylinders, on the one hand, and the lower intermediate cylinders, on the other hand. These lines are conventionally positioned next to the working cylinders.

Such rolling mills typically comprise two pairs of lines, the two lines of each pair being arranged respectively below and above the plane of the strip to be rolled. The two pairs of lines are conventionally arranged on either side of the rolling plane passing through the axes of the working cylinders.

Each one of the lines can be hinged in a pivot to the frame, in order to allow for the adjusting of the position of the line with respect to the strip, or with respect to the cylinders in the vicinity. This adjusting is carried out by rotation of the line about its pivot axis, substantially parallel to the plane of the strip and perpendicular to the direction of travel of the strip. To this effect, each line has a rotating shaft, mounted so as to rotate freely, on one of its ends, in bearings rigidly connected to the frame. A hydraulic cylinder, connecting the frame and the shaft, makes it possible to actuate in rotation the line, then to firmly maintain the line at the desired position.

The various possible positions of the lines can make it possible, in particular, to facilitate the removal of the cylinders, by separating the line or lines from the cylinder to be changed. The various positions can also make it possible to facilitate the insertion of the strip between the working cylinders. As such, and for example, the lines of the pair located upstream, according to the direction of insertion of the strip, can be brought closer to one another in order to physically guide the end of the strip to be introduced on the air gap of the working cylinders, with the lines of the other pair able to be separated in order to facilitate the resumption of the strip, downstream of the working cylinders.

During operation, in the event of an anomaly, in particular in the event of a rupture of the strip, it is not rare that an accumulation of the strips is formed between the lines while the cylinders firmly oppose their separation, and as such cause the rupture of the latter (or of the support thereof), when the force on the lines becomes excessive.

In order to overcome this problem, it is known from the state of the art to provide an assembly by friction, between a ring rigidly connected to the rod of the cylinder and the rotating shaft, rigidly connected to the line. When the force on the line becomes excessive, the resulting torque becomes higher than the friction torque of the assembly and allows a sliding in rotation between the shaft and the ring mounted on the latter; such an assembly by friction has for function to limit the torque to a threshold value, limiting breakage, allowing the lines to separate by rotation according to the pivot axis, when the force becomes excessive.

On the other hand, and according to the observances of the inventor such an assembly by friction creates other problems. First of all, such an assembly by friction does not tolerate the approximations of assembly in that it requires a precise tightening of these members (i.e. screws) in order to adjust the friction torque to the desired value.

In practice, and according to the observances of the inventor, it is not rare to observe a poor tightening of this assembly: in case of excessive tightening, the friction torque becomes excessive and no longer makes it possible to avoid breakage. On the contrary, in the case of excessively weak tightening, the positions of the lines will be disrupted too easily as soon as there is the slightest stress.

Another disadvantage inherent to this assembly is that it requires a maintenance intervention each time a sliding occurs in order to correctly reposition the line.

BRIEF SUMMARY OF THE INVENTION

The purpose of this invention is to overcome the aforementioned disadvantages, by proposing a rolling mill provided with at least one line, and limiting breakage, in particular in the event of a rupture of the strip.

Another purpose of this invention is to propose such a rolling mill that suppresses or simplifies the maintenance, in particular after the breakage of a strip.

Other purposes and advantages shall appear in the following description which is provided solely for the purposes of information and which does not have the intent of limiting it.

The invention first of all relates to a rolling mill including a frame, at least one pair of working cylinders, capable of defining the air gap of the strip to be rolled, as well as at least one line for spraying a lubricant and/or coolant fluid, arranged next to the plane of the strip to be rolled.

According to the invention, said line is rigidly connected to said frame via a mechanical link, said hinged mechanical link comprising resilient means forcing said line into at least one operational position, toward the plane of the strip, and allowing, in the event that a force on said line tends to separate the line, greater than a threshold value, the deformation of the resilient means against the return force thereof, and thus the retraction of the line toward a position separated from said at least one operational position.

According to an embodiment, said line is hinged to said frame, according to a pivot connection of the mechanical link, preferably of the axis of rotation parallel to the plane of the strip to be rolled and perpendicular to the direction of travel of the strip, the resilient means being arranged between the line and the frame, exercising their recalling force in order to provoke the rotation of the line around the axis of rotation of the pivot connection, in the direction of the strip, the retraction of the line of said at least one operational position towards the separated position being obtained by an opposite rotation, around the axis of rotation of the pivot connection.

According to an embodiment, the resilient means work in compression in order to recall said line from the separated position towards said at least one operational position. Alternatively, and according to another embodiment, the resilient means work in extension in order to recall said line from the separated position toward the operational position.

According to an embodiment, said mechanical link comprises, in addition to said resilient means, and the pivot connection, a hydraulic cylinder arranged in series of said resilient means between the frame and the line and, making it possible to adjust the operational position or positions of the line by rotation of the line around the axis of the pivot connection.

According to an embodiment, the rod and the body of the hydraulic cylinder are hinged respectively, on the one hand, to a lug, rigidly connected to the line and, on the other hand, to a bar of which one of the end is hinged according to a first pivot axis to a support rigidly connected to the frame, the other end of the bar being hinged to the body of the hydraulic cylinder, according to a second pivot axis, said resilient means forcing said bar towards an abutted position against the support in said at least one operational position, and in which, in the event of a force greater than said threshold value, said bar separates from this position by a rotation around the first pivot axis by provoking the deformation of the resilient means against the recalling force and in such a way as to allow the pivoting of the line around the axis of rotation of said pivot connection.

According to an embodiment, the resilient means comprise one or several metal springs, such as a helical spring in extension or in compression, or a spring resulting from a stacking of Belleville washers. The resilient means can further comprise a pneumatic spring, according to another alternative.

According to an embodiment, the rolling mill comprises, for the support of each working cylinder, lower or upper:

- a set of first intermediate cylinders, each one bearing on said working cylinder,
- a set of second intermediate cylinders bearing on the first intermediate cylinders,
- several sets of rollers, bearing on the second intermediate cylinders.

According to an embodiment, the rolling mill comprises at least one pair of lines, the two lines of each pair being arranged respectively below and above the plane of the strip to be rolled, with each one of the lines being rigidly connected to said frame via a said mechanical link, hinged, independent, comprising the resilient means. Preferably, the rolling mill comprises two pairs of lines, with the two pairs of lines being arranged on either side of the rolling plane passing through the axes of the two working cylinders.

According to an embodiment, the lines of said at least one pair form, in at least one of their operational position or positions two guiding elements, upper and lower, facilitating the insertion of the strip between said working cylinders.

According to an embodiment, said lines are arranged in an inter-space defined between the working cylinders, lower and upper, with the first intermediate cylinders, lower and upper, said second intermediate cylinders, lower and upper, and the bearing rollers, lower and upper, said mechanical links, possibly their hydraulic cylinders and hoses associated with the cylinders, being arranged in this inter-space, or laterally to the latter, and in such a way as to create a lateral clearance that allows the removal of all of the cylinders by sliding according to their axis, as well as the removal of the rollers of the various assemblies, by sliding according to their axis of rotation, without removal of said mechanical links, where applicable, without removal of the cylinders and hoses associated with the cylinders.

BRIEF DESCRIPTION OF THE DRAWINGS

The invention shall be better understood when reading the following description accompanied by the annexed drawings, among which.

DETAILED DESCRIPTION OF THE PREFERRED EMBODIMENTS

Figure 1:
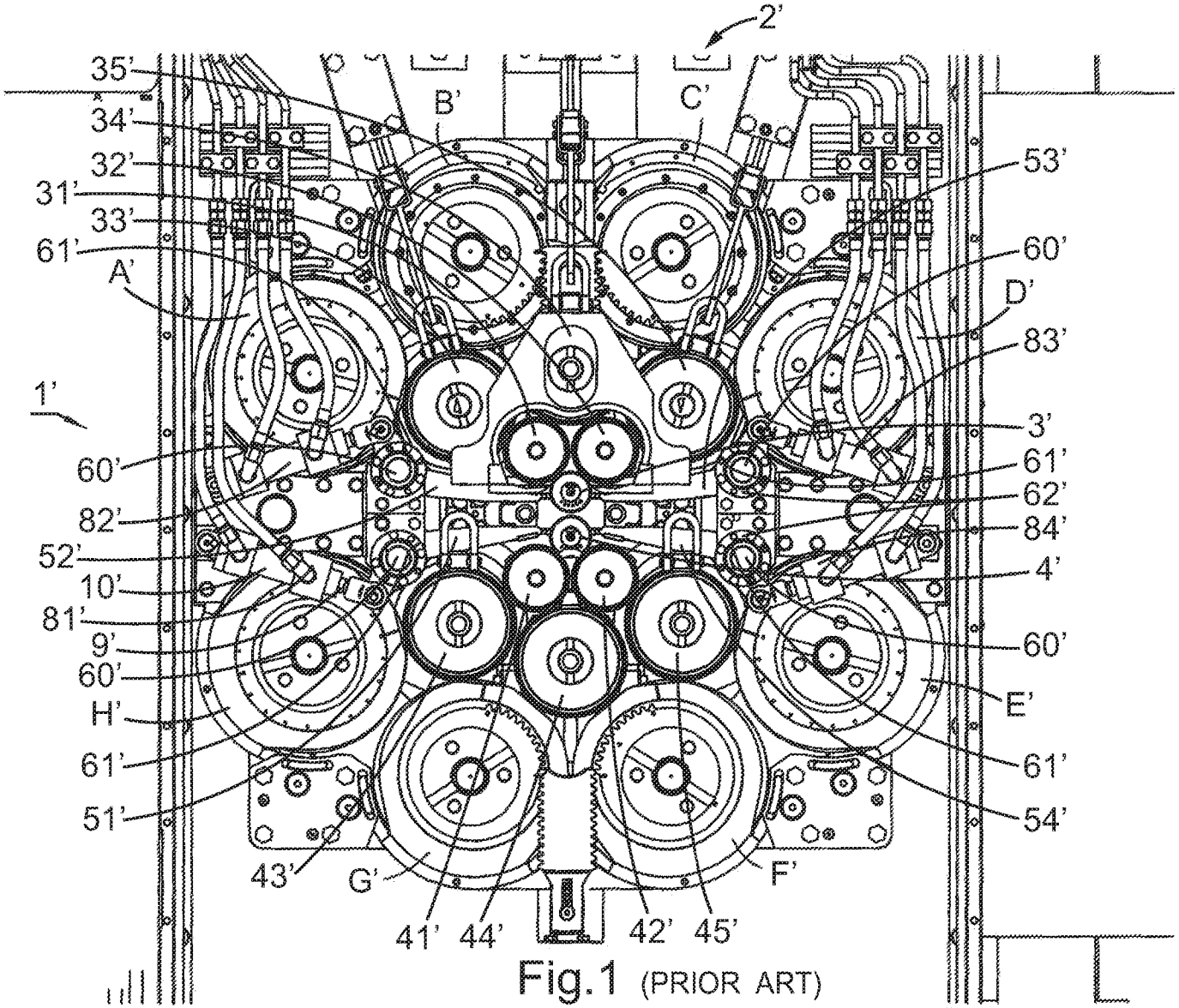
Fig.1 (PRIOR ART)
FIG. 1 is a side view of a rolling mill of the "20 High" type provided with lines, according to prior art.

We shall begin by describing a rolling mill such as known in prior art and shown in FIG. 1. This rolling mill is a rolling mill known by those skilled in the art under the name "20 High". Such a rolling mill comprises two working cylinders, 3' and 4', defining the air gap of the strip to be rolled, as well as intermediate cylinders, and assemblies of rollers for the support of the rolling cylinders. Each working cylinder, upper (referenced as 3') or lower (referenced as 4') is supported by a set of first intermediate cylinders, and a set of second intermediate cylinders, as well as by several roller assemblies A', B', C', D', E', F', G', H'.

Said first intermediate cylinders 31', 32' (resp. 41', 42'), in the number of two, are bearing on the corresponding working cylinder 3' (resp. 4'), themselves supported by the second intermediate cylinders 33', 34', 35' (resp. 43', 44', 45'), in the number of three. The second intermediate cylinders 33', 34', 35' (resp. 43', 44', 45') are themselves supported by the roller assemblies A, B, C, D (resp. E, F, G, H) in the number of four.

Two pairs of lines 51', 52' and 53', 54' are arranged in the frame 2' of the rolling mill and each make it possible to lubricate/cool the strip and the rolling cylinders, from above and from below. These lines are positioned in the frame, on an inter-space between the rolling cylinders. The two pairs 51', 52' and 53', 54' are positioned, respectively on either side of the rolling plane, passing through the axes of the two working cylinders 3' and 4'.

Each line 51'; 52'; 53'; 54' is rigidly connected to a rotating shaft 60' hinged at its ends to the frame in bearings 61'. Each line 51'; 52'; 53'; 54' can be displaced in rotation by means of a double-acting hydraulic cylinder 81'; 82', 83', 84'. More particularly, the body 10 of each cylinder is hinged as a pivot to the frame 2, while the rod is hinged on a lug of a ring mounted on the shaft 60'.

In a known manner, the assembly of the ring 62' on the shaft 60' can be an assembly by friction. When the force on the line becomes excessive, the resulting torque becomes greater than the friction torque of the assembly and allows a sliding in rotation between the shaft 60' and the ring 62' mounted on the latter: such an assembly by friction has for function to limit the torque to a threshold value, limiting breakage, allowing the lines to separate by rotation according to their pivot axis, when the force becomes excessive.

Such an assembly by friction generates the problems identified in the introduction of this application, and in particular the need for maintenance in order to ensure the correct repositioning of the lines each time that this safety is solicited and not provoke a sliding between the ring and the shaft of the line.

Note that, in this prior art, the hydraulic cylinders 81', 82', 83' and 84', as well as their hoses, are positioned laterally to the roller assemblies, marked A', D', E' and H' in such a way that the rollers of these assemblies cannot be removed, according to the axis of the assemblies, without prior removal of the cylinders and of their hoses.

This invention relates to a rolling mill 1 including a frame 2 and a pair of working cylinders 3, 4 capable of defining the air gap of the strip to be rolled, as well as at least one line 51, 52, 53, 54 for spraying a lubricant and/or coolant fluid, arranged next to the plane of the strip to be rolled.

The rolling mill can include, for the support of each working cylinder 3 (or 4), lower or upper:

- a set of first intermediate cylinders 31, 32 (or 41, 42) each one bearing on said working cylinder 3 (or 4),
- a set of second intermediate cylinders 33, 34, 35 (or 43, 44, 45) bearing on the first intermediate cylinders,
- several roller assemblies A, B, C, D (or E, F, G, H), bearing on the second intermediate cylinders 33, 34, 35 (or 43, 44, 45).

According to the embodiment shown, this more particularly entails a rolling mill of the "20 High" type wherein said first intermediate cylinders 31, 32 (resp. 41, 42), in the number of two, are bearing on the corresponding working cylinder (resp. '), themselves supported by the second intermediate cylinders 33, 34, 35 (resp. 43, 44, 45), in the number of three. The second intermediate cylinders 33, 34, 35 (resp. 43, 44, 45) are themselves supported by the roller assemblies A, B, C, D (resp. E, F, G, H) in the number of four.

According to an essential characteristic of the invention, said line 51; 52; 53; 54 (or each one of the lines) is rigidly connected to said frame 2 via a hinged mechanical link, said mechanical link including resilient means 71; 72; 73; 74 forcing said line 51; 52; 53; 54 into at least one operational position, toward the plane of the strip, and allowing, in the event that a force on said line tends to separate the line, greater than a threshold value, the deformation of the resilient means 71; 72; 73; 74 against the return force thereof, and thus the retraction of the line toward a position separated from said at least one operational position.

In the event of an anomaly, in particular of a rupture of a strip and of the formation of an accumulation of strips in the frame, the resilient means 71; 72; 73; 74 allows the line to separate so as to avoid breakage. Once this accumulation is removed, the recall force of the resilient means, allows said line to return towards said at least one operational position, and without any particular maintenance intervention.

Preferably, according to the embodiment shown, the rolling mill 1 comprises at least one pair of lines, with the two lines 51, 52; 53, 54 of each pair being arranged respectively, under and over the plane of the strip to be rolled, with each one of the lines being rigidly connected to said frame via a said mechanical link, hinged, independent, comprising the resilient means 71; 72; 73; 74.

Preferably, according to an embodiment shown, the rolling mill comprises two pairs of lines 51, 52 and 53, 54, with the two pairs of lines being arranged on either side of the rolling plane passing through the axes of the two working cylinders 3, 4.

According to an embodiment, said line or each one of the lines 51; 52; 53; 54 is hinged to said frame according to a pivot connection of the mechanical link, of axis of rotation A1; A2; A3; A4, preferably parallel to the plane of the strip to be rolled and perpendicular to the direction of travel of the strip. To this effect, the or each line 51; 52; 53; 54 can comprise a rotating shaft 60, rigidly connected to the line, hinged to its two ends in bearings 61 rigidly connected to the frame 2.

The resilient means 71; 72; 73; 74 are arranged between the line 51; 52; 53; 54 and the frame 2, exerting their recalling force, more preferably on the rotating shaft, in order to provoke the rotation of the line 51; 52; 53; 54 around the axis of rotation A1; A2; A3; A4 of the pivot connection, in the direction of the strip. The retraction of the line of said at least one operational position towards said separated position is obtained by an opposite rotation, around the axis of rotation A1; A2; A3; A4 of the pivot connection, when an outside force on the line generates a torque greater than that of the recall torque of the resilient means.

According to an embodiment shown, the resilient means 71; 72; 73; 74 work in compression in order to recall said line (or each one of the lines) from the separated position towards said at least one operational position. Alternatively, according to an embodiment not shown, the resilient means work in extension in order to recall said line from the separated position towards the operational position.

According to an embodiment, the resilient means 71; 72; 73; 74 comprise one or several metal springs, such as a helical spring in extension or in compression, or a spring resulting from a stacking of Belleville washers. According to another embodiment not shown, the resilient means comprise a pneumatic spring.

According to an advantageous embodiment, said mechanical link comprises, in addition to said resilient means 71; 72; 73; 74, and the pivot connection, a hydraulic cylinder 81; 82; 83; 84 arranged in series of said resilient means 71; 72; 73; 74 between the frame 2 and the line 51; 52; 53; 54 and making it possible to modify the position of the line by rotation of the line around the axis of rotation A1; A2; A3; A4 of the pivot connection.

According to an embodiment shown, the rod 9 and the body 10 of the hydraulic cylinder 81; 82; 83; 84 can be hinged respectively, on the one hand, to the line 51; 52; 53; 54 and, on the other hand, to a bar 91; 92; 93; 94.

More particularly, the end of the rod 9 is hinged to a lug of a ring 61 mounted on the shaft 60 and rigidly connected to the latter, according to a pivot of an axis parallel to the axis of rotation A1; A2; A3; A4 of said pivot connection of the line 51; 52; 53; 54. Preferably, the assembly between the shaft 60 and the ring 61 prohibits any sliding between these two parts.

One of the ends of the bar 91; 92; 93; 94 is hinged according to a first pivot axis A5 to a support 11 rigidly connected to the frame 2, with the other end of the bar being hinged 91; 92; 93; 94 to the body 10 of the cylinder, according to a second pivot axis A6. The pivot axes A5 and A6 are parallel to the axis of rotation A1; A2; A3; A4 of said pivot connection of the line 51; 52; 53; 54.

According to this embodiment shown, said resilient means 71; 72; 73; 74, force said bar 91; 92; 93; 94 towards an abutted position against the support 11, in said at least one operational position.

Figure 4:
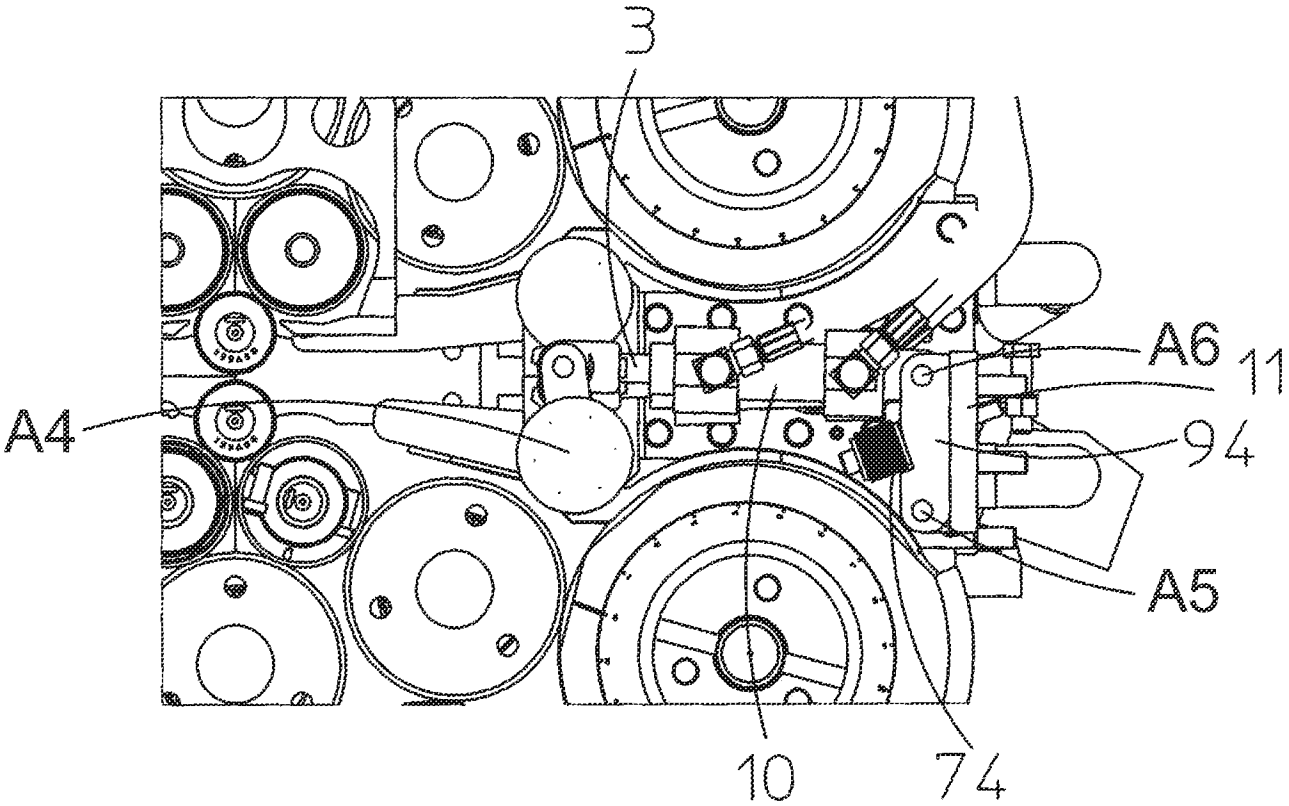
FIG. 4 is a detailed view of the pair of lines (straight) of the rolling mill of FIG. 2.
Figure 5:
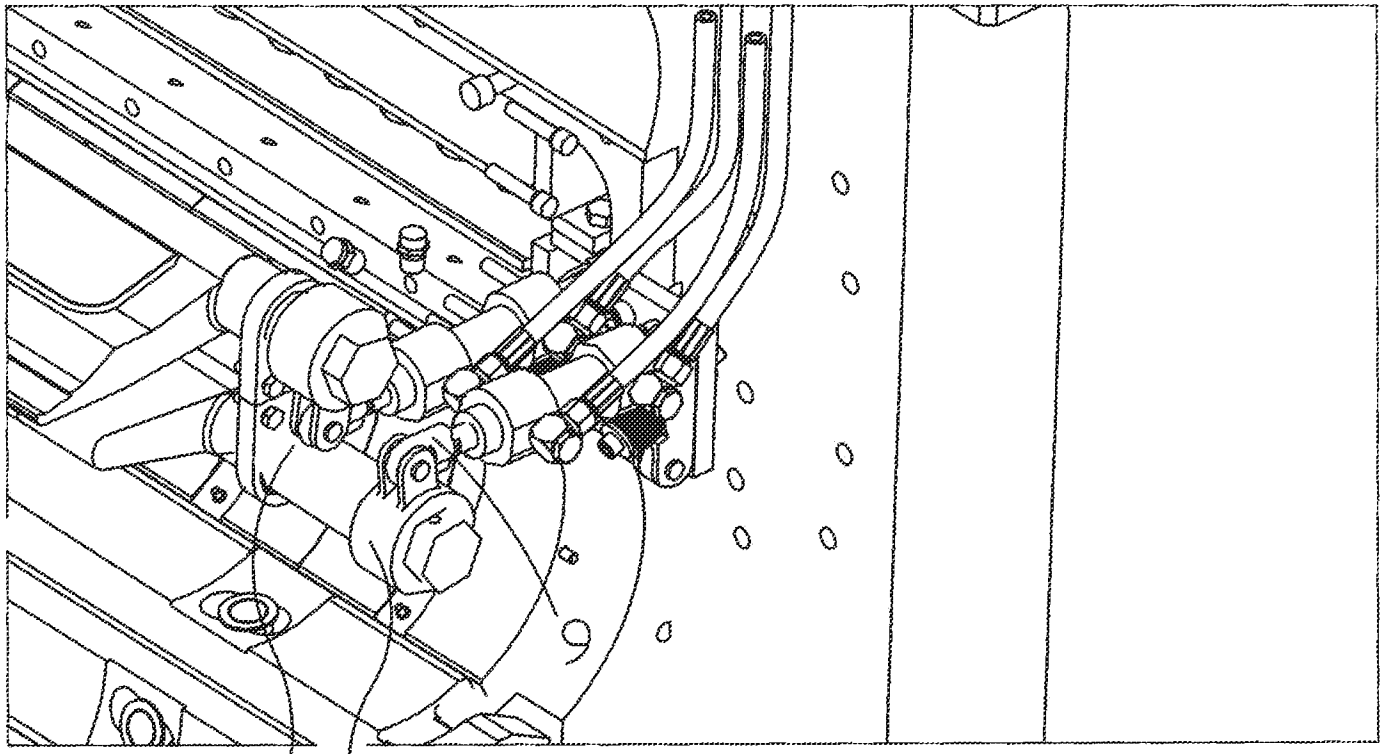
FIG. 5 is a partial perspective view of the rolling mill of FIG. 2, once the rolling cylinders and roller assemblies removed.

Such as shown in FIG. 4, the resilient means 74, comprised by way of example by a stack of spring washers (Belleville washers), are bearing against the bar 94 in order to force the latter in the direction of the support 11.

In the case of a force greater than said threshold value, said bar 94 (or 91; 92; 93) separates from this position by a rotation around the first pivot axis A5 by provoking the deformation of the resilient means 74 (or 71; 72; 73), in particular the compression of the Belleville washers, against the recalling force and in such a way as to allow the pivoting of the line 54 (or 51; 52; 53) around its axis of rotation A4 (or A1; A2; A3), and while the corresponding hydraulic cylinder 84 (81; 82; 83) firmly maintains its position.

The hydraulic cylinder 84 (81; 82; 83), more preferably double-acting, is an actuator that has for function to allow for the adjusting of the operational position and to maintain this position once adjusted. Several operational positions are therefore possible.

Modifying the position of the line, makes it possible, for example, to facilitate the changing of the rolling cylinders during maintenance, by separating the line or lines from the cylinder to be changed, for example, or can make it possible to facilitate the inserting of the end of the strip between the working cylinders.

As such, and according to an embodiment, the lines 51, 52 (or 53, 54) of said at least one pair form, in at least one of their operational position or positions two guiding elements, upper and lower, facilitating the insertion of the strip between said working cylinders.

Said lines 51, 52, 53, 54 are arranged in an inter-space defined between the working cylinders 3, 4, lower and upper, the first intermediate cylinders 31, 32, 41, 42, lower and upper, said second intermediate cylinders 33, 34, 35; 43, 44, 45, lower and upper, and the assemblies of bearing rollers, lower and upper.

Figure 2:
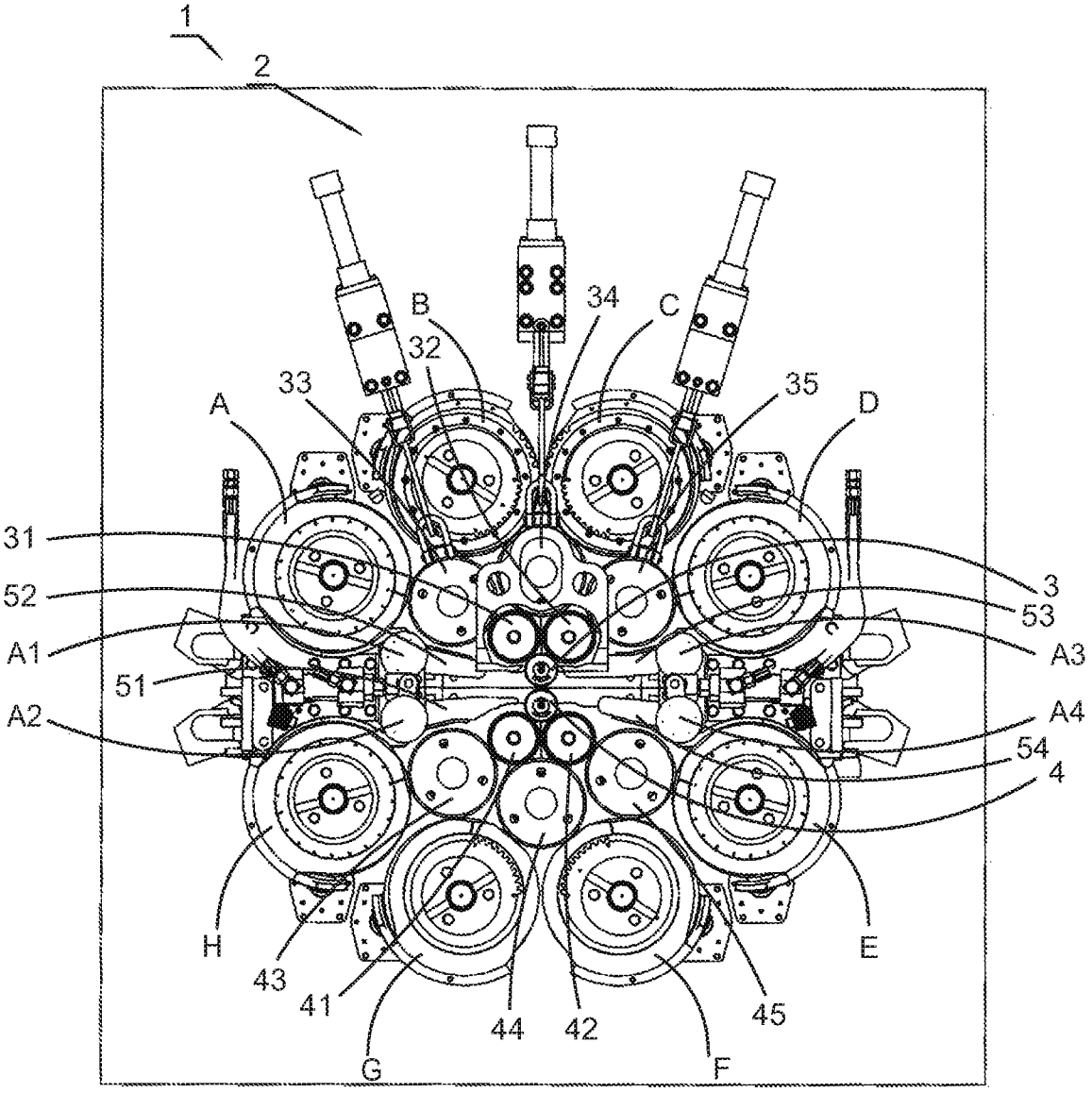
FIG. 2 is a side view of a rolling mill of the "20 High" type provided with lines, in accordance with the invention according to an embodiment.
Figure 3:
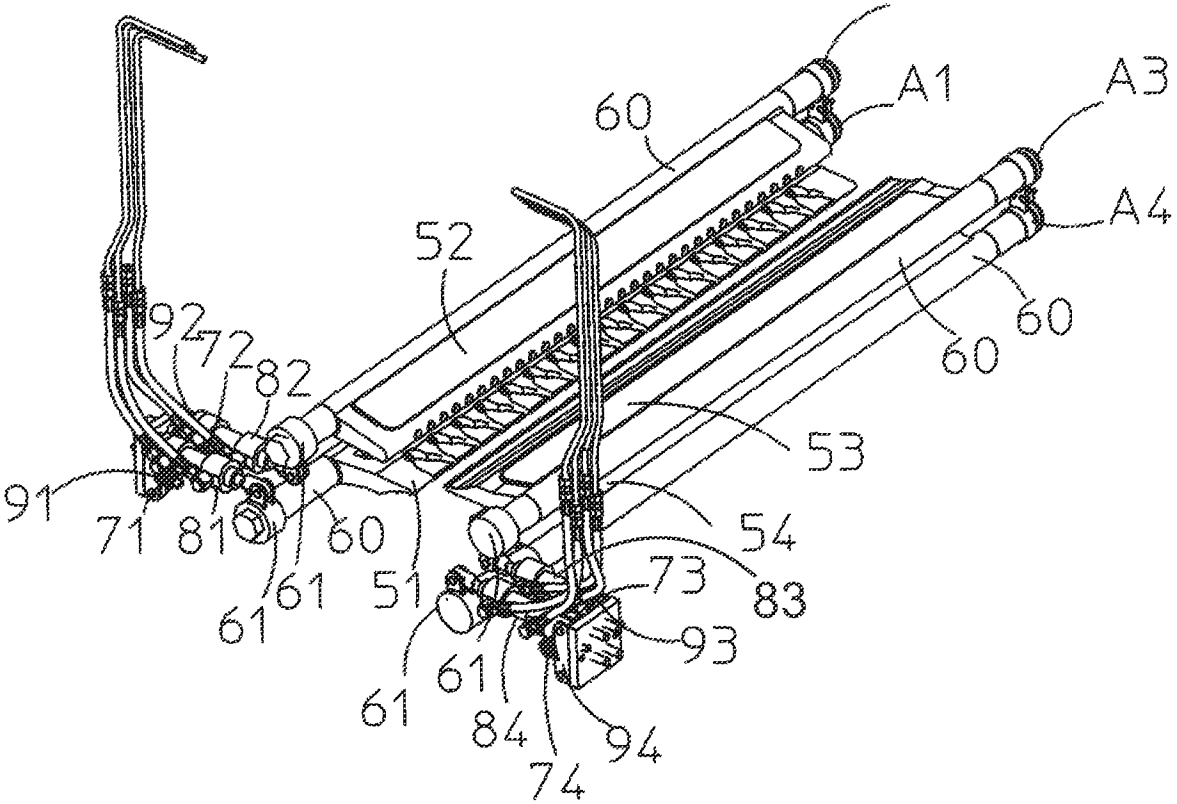
FIG. 3 is a detailed view of the lines of FIG. 2, as well as of their hinged mechanical link.

Preferably, according to the embodiment shown in a non-limiting manner in FIG. 2, said mechanical links, where applicable their hydraulic cylinders 81, 82, 83, 84 and hoses associated with the cylinders, are arranged in this inter-space, or laterally to the latter, and in such a way as to create a lateral clearance that allows the removal of all of the cylinders 31, 32, 33, 34, 35, 41, 42, 43, 44, 45 by sliding according to their axis, as well as the removal of the rollers from the various assemblies A to H, by sliding according to their axis of rotation, without removal of said mechanical links, and where applicable, without removal of the cylinders 81, 82, 83, 84 and hoses associated with the cylinders.

It is as such possible to change all of the rolling cylinders and rollers of the various assemblies, including the roller assemblies A, D E and H, without removal of the mechanical links, and in particular without removal of the cylinders and hoses associated with the cylinders, contrary to the state of the art shown in FIG. 1.

To this effect, and such as shown in a non-limiting manner in the figures, the cylinders 81, 82 (or 83, 84) associated with the lines 51, 52 (or 53, 54) of the same pair can be positioned, in juxtaposition, substantially one behind the other according to the direction of the rolling cylinders, in order to limit their encumbrance.

Naturally other embodiments could have been considered by those skilled in the art without however leaving the scope of the invention such as defined by the claims hereinafter.

NOMENCLATURE

Invention (FIGS. 2 to 5):

1. Rolling mill,
2. Cage,
3. Upper working cylinder,
4. Lower working cylinder,
9. Cylinder rod,
10. Cylinder body,
11. Support,
31, 32. First intermediate cylinders (upper),
33, 34, 35. Second intermediate cylinders (upper),
41, 42. First intermediate cylinders (lower),
43, 44, 45. Second intermediate cylinders (lower),
51, 52, 53, 54. Lines, respectively lower left, upper left, upper right and lower right,
71, 72, 73, 74. Resilient means associated respectively with said lower left, upper left, upper right and lower right lines,
60. Rotating shaft,
81, 82, 83, 84. Hydraulic cylinders associated respectively with said lower left, upper left, upper right and lower right lines,
91, 92, 93, 94 Bars of the mechanical links associated respectively with said lower left, upper left, upper right and lower right lines.
A, B, C, D. Roller assemblies bearing on the second intermediate cylinders (upper),
E, F, G, H. Roller assemblies bearing on the second intermediate cylinders (lower),
A1, A2, A3, A4. Axes of rotation of the pivot connections associated respectively with said lower left, upper left, upper right and lower right lines,
A5. Pivot axis.

PRIOR ART (FIG. 1)

1'. Rolling mill,
2'. Cage,
3'. Upper working cylinder,
4'. Lower working cylinder,
9'. Cylinder rod,
10'. Cylinder body,
31, 32. First intermediate cylinders (upper),
33, 34, 35. Second intermediate cylinders (upper),
41', 42'. First intermediate cylinders (lower),
43', 44', 45'. Second intermediate cylinders (lower),
51', 52', 53', 54'. Lines, respectively lower left, upper left, upper right and lower right,
60'. Rotating shaft (line),
61'. Bearing,
81', 82', 83', 84'. Hydraulic cylinders associated respectively with said lower left, upper left, upper right and lower right lines.

The invention claimed is:

1. A rolling mill (1) comprising:
a frame (2),
at least one pair of working cylinders (3, 4) capable of defining the thickness of a strip to be rolled,
at least one line (51, 52, 53, 54) for spraying a lubricant and/or coolant fluid, arranged next to a plane of the strip to be rolled, wherein said line (51; 52; 53; 54) is rigidly connected to said frame via a hinged mechanical link, said mechanical link including resilient means (71; 72; 73; 74) comprising a spring having a return force, said mechanical link being configured, in an event of a rupture of the strip and of the formation of an accumulation of strips in the frame, to separate the line from at least one operational position to a position separated from said at least one operational position so as to avoid breakage of the line once a force generated by said accumulation of strips on said line is greater than a threshold value, by deformation of the resilient means (71; 72; 73; 74) against the return force, and thus the retraction of the line toward the position separated from said at least one operational position, wherein, once the accumulation of strips is removed, the return force of said resilient means forces said line (51; 52; 53; 54) to move from said position separated into said at least one operational position, toward the plane of the strip, and wherein said line (51; 52; 53; 54) is hinged to said frame (2) via a pivot connection of said mechanical link, said mechanical link having an axis of rotation (A1; A2; A3; A4) parallel to the plane of the strip to be rolled and perpendicular to the direction of travel of the strip, wherein the resilient means (71; 72; 73; 74) is arranged between the line (51; 52; 53; 54) and the frame (2), exerting the return force in order to cause the rotation of the line (51; 52; 53;54) around the axis of rotation (A1; A2; A3; A4) of the pivot connection, towards the plane of the strip to be rolled from said position separated from said at least one operational position into said at least one operation position once the accumulation of the strips is removed, the retraction of the line from said at least one operational position towards said separated position from said at least one operational position being obtained by an opposite rotation around the axis of rotation (A1; A2; A3; A4) of the pivot connection, and wherein said accumulation of strips exerts the force on said line greater than the threshold value.

2. The rolling mill according to claim 1, wherein the resilient means (71; 72; 73; 74) work in compression to recall said line from the separated position towards said at least one operational position.

3. The rolling mill according to claim 1, wherein the resilient means work in extension in order to recall said line from the separated position towards the operational position.

4. The rolling mill according to claim 1, wherein said mechanical link comprises, in addition to said resilient means (71; 72; 73; 74), and the pivot connection, a hydraulic cylinder (81; 82; 83; 84) arranged in series with said resilient means (71; 72; 73; 74) between the frame (2) and the line (51; 52; 53; 54) to modify the position of the line (51; 52; 53; 54) by rotation of the line around the axis of rotation (A1; A2; A3; A4) of the pivot connection.

5. The rolling mill according to claim 4, wherein, the rod (9) and the body (10) of the hydraulic cylinder (81; 82; 83; 84) are hinged respectively, to the line (51; 52; 53; 54) and to a bar (91; 92; 93; 94), the bar has a first end hinged according to a first pivot axis (A5) to a support (11) rigidly connected to the frame (2), and a second end hinged (91; 92; 93; 94) to the body (10) of the cylinder, according to a second pivot axis (A6), said resilient means (71; 72; 73; 74), forcing said bar (91; 92; 93; 94) towards an abutted position against the support (11) in said at least one operational position, where in the case of a force greater than said threshold value, said bar (91; 92; 93; 94) separates from the abutted position by a rotation around the first pivot axis (A5) by provoking the deformation of the resilient means (71; 72; 73; 74), against the return force and in such a way as to allow the pivoting of the line (51; 52; 53; 54) around the axis of rotation (A1; A2; A3; A4) of said pivot connection.

6. The rolling mill according to claim 1, wherein the spring of the resilient means (71; 72; 73; 74), is a metal spring.

7. The rolling mill according to claim 1, wherein the spring of the resilient means is a pneumatic spring.

8. The rolling mill according to claim 1, comprising, for the support of each working cylinder (3; 4), lower or upper:

a set of first intermediate cylinders (31, 32; 41, 42) each one bearing on said working cylinder (3; 4), a set of second intermediate cylinders (33, 34, 35; 43, 44, 45) bearing on the first intermediate cylinders, plural roller assemblies (A, B, C, D, E, F, G, H), bearing on the second intermediate cylinders (33, 34, 35; 43, 44, 45).

9. The rolling mill according to claim 8 comprising at least one pair of lines, with the two lines (51, 52; 53, 54) of each pair being arranged respectively below and above the plane of the strip to be rolled, with each one of the two lines being rigidly connected to said frame via said mechanical link.

10. The rolling mill according to claim 9 comprising two pairs of lines (51, 52, 53, 54), with the two pairs of lines being arranged on either side of the plane of the strip to be rolled passing through the axes of the two working cylinders (3, 4).

11. The rolling mill according to claim 9, wherein, said lines (51, 52, 53, 54) are arranged in an inter-space defined between the working cylinders (3, 4), the first intermediate cylinders (31, 32, 41, 42), said second intermediate cylinders (33, 34, 35; 43, 44, 45), and the roller assemblies, said mechanical links, being arranged in the inter-space, or laterally to the inter-space, and in such a way as to create a lateral clearance that allows the removal of all of the first and second intermediate cylinders (31, 32, 33, 34, 35, 41, 42, 43, 44, 45) by sliding according to the axis, as well as the removal of the rollers from the plural roller assemblies (A to H), by sliding according to the axis of rotation, without removal of said mechanical links.

12. The rolling mill according to claim 6, wherein the metal spring comprises a helical spring.

13. The rolling mill according to claim 6, wherein the metal spring comprises a stacking of belleville washers.

14. The rolling mill according to claim 2, wherein the spring of the resilient means (71; 72; 73; 74), is a metal spring.

15. A rolling mill (1) comprising:

a frame (2);

working cylinders (3, 4) that define a thickness of a strip to be rolled, the working cylinders (3, 4) being arranged inside the frame;

a spraying line (51, 52, 53, 54) arranged next to a plane of the strip to be rolled, the spraying line for spraying at least one of a lubricant and a coolant fluid, the spraying line (51; 52; 53; 54) having a pivot axis;

a hinged mechanical link having a pivot connection, the mechanical link having an axis of rotation (A1; A2; A3;

A4) parallel to the plane of the strip to be rolled and perpendicular to a direction of travel of the strip, the mechanical link rigidly connecting the spraying line (51; 52; 53; 54) to said frame and allowing the spraying line (51; 52; 53; 54) to pivot with respect to said frame about the pivot axis of the spraying line (51; 52; 53; 54), the mechanical link including resilient means (71; 72; 73; 74) comprising a spring having a return force, the mechanical link including the resilient means (71; 72; 73; 74) being configured to force said spraying line (51, 52, 53, 54) into an operational position, the mechanical link further being configured, in an event of a rupture of the strip and of formation of an accumulation of strips in the frame and once a force generated by said accumulation of strips on the spraying line is greater than a threshold value, to retract the spraying line from the operational position to a position separated from the operational position by deformation of the resilient means (71; 72; 73; 74) against the return force, so as to avoid breakage of the spraying line once the force generated by said accumulation of strips on the spraying line is greater than the threshold value, the deformation of the resilient means (71; 72; 73; 74) against the return force retracting the spraying line toward the position separated from the operational position, wherein, once the accumulation of strips is removed, the return force of said resilient means forces the spraying line (51; 52; 53; 54) to move from said position separated from the operational position into the operational position, toward the plane of the strip, and wherein the resilient means (71; 72; 73; 74) is arranged between the spraying line (51; 52; 53; 54) and the frame (2), the resilient means (71; 72; 73; 74) exerting the return force in order to cause the rotation of the spraying line (51; 52; 53; 54) around the axis of rotation (A1; A2; A3; A4) of the pivot connection, towards the plane of the strip to be rolled from said position separated from the operational position into the operation position once the accumulation of the strips is removed, the retraction of the spraying line from the operational position towards said position separated from the operational position being obtained by an opposite rotation around the axis of rotation (A1; A2; A3; A4) of the pivot connection.

* * * * *